US010701966B2

(12) United States Patent
Sinisi et al.

(10) Patent No.: US 10,701,966 B2
(45) Date of Patent: Jul. 7, 2020

(54) APPARATUS AND METHOD FOR WRAPPING A SHEET OF WRAPPING MATERIAL AROUND A ROD-SHAPED ARTICLE

(71) Applicant: PHILIP MORRIS PRODUCTS S.A., Neuchatel (CH)

(72) Inventors: Mario Sinisi, Sainte-Croix (CH); Pierre-Yves Gindrat, Saxon (CH)

(73) Assignee: Philip Morris Products S.A., Neuchatel (CH)

( * ) Notice: Subject to any disclaimer, the term of this patent is extended or adjusted under 35 U.S.C. 154(b) by 524 days.

(21) Appl. No.: 14/760,752

(22) PCT Filed: Jan. 31, 2014

(86) PCT No.: PCT/EP2014/051869

§ 371 (c)(1),
(2) Date: Jul. 14, 2015

(87) PCT Pub. No.: WO2014/118309

PCT Pub. Date: Aug. 7, 2014

(65) Prior Publication Data

US 2015/0351450 A1 Dec. 10, 2015

(30) Foreign Application Priority Data

Jan. 31, 2013 (EP) ..... 13153418

(51) Int. Cl.
*A24C 5/10* (2006.01)
*A24C 5/47* (2006.01)

(52) U.S. Cl.
CPC ..... *A24C 5/10* (2013.01); *A24C 5/471* (2013.01)

(58) Field of Classification Search
None
See application file for complete search history.

(56) References Cited

U.S. PATENT DOCUMENTS 485,146 A * 10/1892 Bazerque ..... A24C 5/473 131/34
2,189,886 A 2/1940 Edwards
(Continued)

FOREIGN PATENT DOCUMENTS

CN 1879510 12/2006
CN 1742639 10/2011
(Continued)

OTHER PUBLICATIONS

PCT Search Report and Written Opinion for PCT/EP2014/051869 dated Feb. 26, 2014 (7 pages).

*Primary Examiner* — Joseph S Del Sole
*Assistant Examiner* — Manley L Cummins, IV
(74) *Attorney, Agent, or Firm* — Mueting Raasch Group

(57) ABSTRACT

An apparatus for wrapping a sheet of wrapping material (5) around a rod-shaped article (4) or a plurality of linearly arranged substantially cylindrical segments, either of which comprises a fragile segment (40), comprising: —a rotatable drum (2) having a circumferential drum surface (20) comprising a plurality of flutes (21) adapted to hold a rod-shaped article (4) or a plurality of linearly arranged substantially cylindrical segments, and comprising attachment portions (22) arranged between the flutes (21) adapted to hold a sheet of wrapping material (5) having an adhesive on an outer surface, —a rolling device (1) comprising a contact surface (10) arranged at a predetermined distance from the drum surface (20), to contact a periphery of the rod-shaped article (4) or plurality of linearly arranged substantially cylindrical segments to make the rod-shaped article (4) or plurality of linearly arranged substantially cylindrical segments move out of the flute (21) and roll over the outer surface having the adhesive thereon to wrap the sheet of wrapping material (5) around the rod-shaped article (4) or plurality of linearly arranged substantially cylindrical segments. At least a portion (101) of the contact surface (10) is resiliently displaceable away from the circumferential drum surface (20).

7 Claims, 3 Drawing Sheets

(56) References Cited

U.S. PATENT DOCUMENTS

| | | | | | |
|---|---|---|---|---|---|
| 2,808,059 | A | | 10/1957 | Stelzer | |
| 3,077,889 | A | * | 2/1963 | Patterson | A24C 5/471 131/94 |
| 3,093,143 | A | | 6/1963 | Rudszinat | |
| 3,176,694 | A | * | 4/1965 | Heinz | A24C 5/471 131/94 |
| 3,527,234 | A | * | 9/1970 | Hinzmann | A24C 5/471 131/94 |
| 4,431,010 | A | * | 2/1984 | Seragnoli | A24C 5/471 131/88 |
| 4,492,238 | A | * | 1/1985 | Wheless | A24D 3/0258 131/94 |
| 4,644,961 | A | * | 2/1987 | Horie | A24C 5/471 131/94 |
| 4,745,932 | A | * | 5/1988 | Mattei | A24C 5/471 131/94 |
| 4,825,882 | A | * | 5/1989 | Hinz | A24C 5/471 131/94 |
| 5,577,518 | A | * | 11/1996 | Draghetti | A24C 5/471 131/32 |
| 2007/0001392 | A1 | | 1/2007 | Schmick | |

FOREIGN PATENT DOCUMENTS

| | | |
|---|---|---|
| EP | 0168549 | 1/1986 |
| WO | WO 2013/145122 | 10/2013 |

* cited by examiner

APPARATUS AND METHOD FOR WRAPPING A SHEET OF WRAPPING MATERIAL AROUND A ROD-SHAPED ARTICLE

This application is a U.S. National Stage Application of International Application No. PCT/EP2014/051869, filed Jan. 31, 2014, which was published in English on Aug. 7, 2014 as International Patent Publication WO 2014/118309 A1. International Application No. PCT/EP2014/051869 claims priority to European Application No. 13153418.2 filed Jan. 31, 2013.

The present invention relates to an apparatus and a method for wrapping a sheet of wrapping material around a rod-shaped article, such as a smoking article, or around a plurality of linearly arranged substantially cylindrical segments, either of which comprises at least one fragile element.

While wrapping rod-shaped articles, forces may act upon the rod-shaped articles or upon individual segments of the rod-shaped articles. For example, when wrapping a tipping material around a tobacco rod and a filter rod, the tobacco rod and the filter rod may temporarily be compressed between two surfaces moving relative to one another. However, in case the smoking article as a whole is fragile or comprises one or more fragile segments, such as for example a brittle heat source, the fragile smoking article or the one or more fragile segments may get damaged due to being exposed to a compression force that is too high.

Therefore, there is a need for an apparatus and a method for wrapping rod-shaped articles or a plurality of linearly arranged substantially cylindrical segments, which are fragile or comprise one or more fragile segments. This apparatus and method should prevent the rod-shaped article or the one or more fragile segments from getting damaged.

According to one aspect of the invention there is provided an apparatus for wrapping a sheet of wrapping material around a rod-shaped article or around a plurality of linearly arranged substantially cylindrical segments, either of which comprises a fragile segment. A "rod-shaped article" as used herein denotes an article having the shape of a rod, that is to say the length of the article is greater than the diameter of the article. The term "article" in this respect is to be understood as a physical entity that can only be handled as a whole. For example, a rod-shaped article may be a smoking article which is already wrapped and around a portion of which an additional wrapper is to be wrapped. However, a rod-shaped article may also denote a physical entity which constitutes only a part of a smoking article—wrapped or unwrapped—which entity is to be combined with one or more additional parts of a smoking article to form the smoking article. The term "plurality of linearly arranged substantially cylindrical segments" denotes an arrangement of individual substantially cylindrical segments each forming an individual physical entity. The term "substantially cylindrical segments" is to be understood to include segments which have the shape of a cylinder or a tapered cylinder of circular or substantially circular cross-section, or which have the shape of a cylinder or a tapered cylinder of elliptical or substantially elliptical cross-section. While various combinations and arrangements of these slightly different shapes of segments are possible, in a preferred embodiment all linearly arranged segments have the shape of a cylinder having a circular cross-section. These individual substantially cylindrical segments are linearly arranged with the cylinder axes of the individual substantially cylindrical segments being coincident. Such plurality of (individual) linearly arranged substantially cylindrical segments may or may not have a rod-shape. The overall length of the plurality of linearly arranged substantially cylindrical segments may be greater than the greatest diameter, and in this case the plurality of segments has a rod-shape but does not qualify as a rod-shaped "article" due to not forming a common physical entity. Alternatively, the overall length of the plurality of linearly arranged substantially cylindrical segments may also be smaller than the greatest diameter so that it does not have a rod-shape. The apparatus comprises a rotatable drum having a central longitudinal axis and a circumferential drum surface. The term "central longitudinal axis" in this respect denotes the longitudinal axis of the drum with respect to which the drum is rotationally symmetrical and about which the drum rotates in operation. The circumferential drum surface comprises a plurality of flutes extending in a direction parallel to the central longitudinal axis of the drum. Each flute is adapted to hold within it a rod-shaped article or a plurality of substantially cylindrical segments. Either of the rod-shaped article or the plurality of linearly arranged substantially cylindrical segments comprises at least one fragile segment. The circumferential drum surface further comprises attachment portions arranged between the flutes. Each attachment portion is adapted to hold a sheet of wrapping material against the respective attachment portion, with the sheet of wrapping material having an adhesive on an outer surface of the wrapping material, and this outer surface having the adhesive thereon faces away from the circumferential drum surface. The apparatus further comprises a rolling device comprising a contact surface arranged at a predetermined distance from the circumferential drum surface. Typically, the contact surface of the rolling device is adapted to make the rod-shaped article or the plurality of linearly arranged substantially cylindrical segments roll along the contact surface. The predetermined distance of the contact surface from the circumferential drum surface is chosen such that the contact surface contacts a periphery of the respective to-be-wrapped rod-shaped article or the to-be-wrapped plurality of linearly arranged substantially cylindrical segments in the respective flute so as to make the rod-shaped article or the plurality of linearly arranged substantially cylindrical segments move out of the flute and roll over the outer surface of a sheet of wrapping material having the adhesive thereon. The sheet of wrapping material that wraps around the to-be-wrapped rod-shaped article or the plurality of linearly arranged substantially cylindrical segments is held on an attachment portion adjacent to the flute that held the to-be-wrapped rod-shaped article or the plurality of linearly arranged cylindrical segments. In the apparatus according to the invention, at least a portion of the contact surface is resiliently displaceable away from the circumferential drum surface.

The rod-shaped article or the plurality of linearly arranged substantially cylindrical segments are moved out of the flute of the rotatable drum and are then caused to roll over the outer surface of the sheet of wrapping material having the adhesive thereon. The rod-shaped article or the plurality of linearly arranged substantially cylindrical segments are thereby wrapped with the wrapping material, which may then be rolled into an empty flute in the circumferential drum surface and transported therein for further processing.

To make the rod-shaped article or the plurality of linearly arranged substantially cylindrical segments move out of the respective flute, the contact surface of the rolling device contacts the rod-shaped article or the plurality of linearly arranged substantially cylindrical segments. Through the rotational movement of the drum and through the contact surface of the rolling device contacting the rod-shaped article or the plurality of linearly arranged substantially cylindrical segments, a force is exerted onto the rod-shaped article or the plurality of linearly arranged substantially cylindrical segments. As a result of this force, the rod-shaped article or the plurality of linearly arranged substantially cylindrical segments are moved out of the respective flute. With respect to the circumferential drum surface, the rod-shaped article or the plurality of linearly arranged substantially cylindrical segments then roll over the outer surface of the sheet material having the adhesive thereon in a direction counter to the direction of rotation of the drum to allow the sheet of wrapping material to wrap around the rod-shaped article or the plurality of linearly arranged substantially cylindrical segments. However, with respect to the contact surface of the rolling device, the rod-shaped article or the plurality of linearly arranged substantially cylindrical segments roll over the contact surface in the direction of rotation of the drum. By displacing the resilient portion of the contact surface, the force exerted on the rod-shaped article or the plurality of linearly arranged substantially cylindrical segments is reduced and thus prevents the rod-shaped article or the plurality of linearly arranged substantially cylindrical segments, and in particular the at least one fragile segment of the rod-shaped article or of the plurality of linearly arranged substantially cylindrical segments, from getting damaged. Accordingly, the resiliently displaceable portion of the outer surface is adapted to be displaced such as to exert a force onto the rod-shaped article or the plurality of linearly arranged substantially cylindrical segments that is high enough to make the rod-shaped article or the plurality of linearly arranged substantially cylindrical segments move out of the flute on one hand. On the other hand, the resiliently displaceable portion is adapted to be displaced to exert a force onto the rod-shaped article or the plurality of linearly arranged substantially cylindrical segments that is low enough not to damage or break the rod-shaped article or the plurality of linearly arranged substantially cylindrical segments, and in particular not to damage the at least one fragile segment thereof.

From a constructional point of view, the resiliently displaceable portion of the contact surface may for example be realized with the aid of spring means supporting a rigid non-deformable contact surface, or by providing a contact surface made of a resiliently deformable material. The resiliently displaceable portion of the contact surface is displaced in a direction away from the circumferential drum surface as the rod-shaped article or the plurality of linearly arranged substantially cylindrical segments are moved out of their flute. Once the rod-shaped article or the plurality of linearly arranged substantially cylindrical segments have been moved out of their flute, the displaced portion of the contact surface is returned back in the direction towards the circumferential drum surface so as to be arranged in a position to make the rod-shaped article or the plurality of linearly arranged substantially cylindrical segments positioned in the next flute of the drum move out of the flute upon reaching the contact surface of the rolling device.

With the apparatus according to the invention a wide variety of rod-shaped articles or of linearly arranged substantially cylindrical segments may be wrapped without the risk of damaging the rod-shaped article or the linearly arranged substantially cylindrical segments during the wrapping process. The apparatus according to the invention is particularly suitable for rod-shaped articles being fragile as a whole or containing a fragile segment. By way of example only, such rod-shaped article may be a smoking article or a part of a smoking article comprising a fragile segment. This fragile segment may be a heat source. For example, the heat source may be a brittle carbonaceous heat source. Alternatively, or in addition, the fragile segment may for example also be a brittle filter segment or a plastically deformable segment of a smoking article. For example, in the apparatus according to the invention a sheet of wrapping material may be wrapped around two individual linearly arranged substantially cylindrical segments, a heat source and a tobacco containing segment. Generally, in the apparatus according to the invention, the entire rod-shaped article may be wrapped or only a part of the rod-shaped article may be wrapped, or only two or more individual linearly arranged substantially cylindrical segments may be wrapped. By being wrapped, two or more individual segments may not only be wrapped but may at the same time also be connected to each other to form a rod-shaped article. Accordingly, a rod-shaped article may roll along the contact surface of the rolling device over the entire length of the rod-shaped article, or only a portion of the rod-shaped article may roll along the contact surface (for example if only a portion of the rod-shaped article is to be wrapped).

A wrapping sheet material may for example be a sheet material made of paper, plastic, metal or a combination of these materials. For example, the sheet of wrapping material may be a sheet of metal foil, such as for example an aluminum foil.

At least a leading portion and a trailing portion of the sheet of wrapping material (viewed in the direction of rotation of the drum) have an adhesive on that outer surface facing away from the drum. In one preferred embodiment, the sheet material has no adhesive on the same outer surface in the area between the leading portion and the trailing portion. The adhesive on the leading portion makes the sheet of wrapping material adhere preferably over the entire length of the sheet to the rod-shaped article or the plurality of linearly arranged substantially cylindrical segments once the rod-shaped article or the plurality of linearly arranged substantially cylindrical segments have been moved out of the flute and have been rolled onto the leading portion. During further rotation of the drum, the wrapping material is wrapped around the rod-shaped article or the plurality of linearly arranged substantially cylindrical segments. The adhesive on the trailing portion makes the trailing portion of the sheet of wrapping material remain attached to that outer surface of the leading portion of the sheet of wrapping material, which faced the circumferential drum surface before being wrapped around the rod-shaped article or the plurality of linearly arranged substantially cylindrical segments. The outer surface of the leading portion of the sheet of wrapping material to which the trailing portion of the sheet of wrapping material attaches faces outwardly from the wrapped rod-shaped article or the wrapped plurality of linearly arranged substantially cylindrical segments and does not have an adhesive thereon. Thus, after completion of the rolling process, the sheet material is completely wrapped around the rod-shaped article (or a portion of the rod-shaped article) or around the plurality of linearly arranged substantially cylindrical segments and is secured thereto. Alternatively, the entire surface of the sheet material facing away from the circumferential drum surface may have an adhesive thereon, rather than only a leading portion and a trailing portion thereof.

According to an aspect of the apparatus according to the invention, the resiliently displaceable portion of the contact surface is a surface of a spring-mounted member.

Spring-mounted members allow for a determination of the resilient force acting on the rod-shaped article or the plurality of linearly arranged substantially cylindrical segments by selecting a suitable spring. For example, the spring-mounted member may comprise one or more mechanical springs (such as coil springs) or one or more pneumatic springs. Also, the spring-mounted member may allow for fine-tuning of the resilient force, for example by pre-biasing the spring. Mechanical spring-mounted members are especially cost efficient and are substantially maintenance-free.

According to another aspect of the apparatus according to the invention, the resiliently displaceable portion of the contact surface comprises a lip projecting towards the circumferential drum surface.

The lip projecting towards the circumferential drum surface makes contact with the periphery of the rod-shaped article or the plurality of linearly arranged substantially cylindrical segments as the drum is rotated and the rod-shaped article or the plurality of linearly arranged substantially cylindrical segments reach the lip. This contact of the lip with the rod-shaped article or the plurality of linearly arranged substantially cylindrical segments results in a force being exerted on the rod-shaped article or the plurality of linearly arranged substantially cylindrical segments held in the flute and causes the rod-shaped article or the plurality of linearly arranged substantially cylindrical segments to move out of the flute. The lip together with the rest of the resiliently displaceable portion of the outer surface is then displaced outwardly away from the circumferential drum surface to prevent the rod-shaped article or the plurality of linearly arranged substantially cylindrical segments (and in particular the fragile segment thereof) from getting damaged. However, as long as the lip is in contact with the rod-shaped article or the plurality of linearly arranged substantially cylindrical segments it further assists in moving the rod-shaped article or the plurality of linearly arranged substantially cylindrical segments out of the flute and onto the outer surface of the sheet of wrapping material having the adhesive thereon. For example, the lip is arranged to extend parallel to the flute in the circumferential drum surface and, accordingly, also parallel to the rod-shaped article or the plurality of linearly arranged substantially cylindrical segments held in the flute. Preferably, the lip extends over the entire width of the contact surface of the rolling device, and the lip may also extend over the entire length of the flute. Preferably, however, the lip extends only over part of the length of the flute, for example only over that part of the length of the rod-shaped article that is to be wrapped with a sheet of wrapping material. Thus, the lip may contact the rod-shaped article or the plurality of linearly arranged substantially cylindrical segments either along the entire length of the rod-shaped article or at least along a portion of that length, and therefore exerts a homogeneously distributed force on the rod-shaped article along the entire length or along the portion of the length of the rod-shaped article over which the lip contacts the rod-shaped article or the plurality of linearly arranged substantially cylindrical segments.

In some embodiments the lip has a triangular cross-section, with a ridge of the lip projecting from the resiliently displaceable portion of the contact surface towards the circumferential drum surface.

The lip having the triangular cross-section may be arranged such that the ridge of the lip is arranged parallel to and extends over the entire length or over a part of the length of the flute in the circumferential drum surface. By providing a lip having a triangular cross section with a ridge projecting towards the circumferential drum surface, the rod-shaped article or the plurality of linearly arranged substantially cylindrical segments may move along a sloping surface of the lip during their movement out of the flute and onto the sheet of wrapping material in a continuous movement. At the same time, the lip together with the rest of the resiliently displaceable portion of the outer surface is resiliently displaced outwardly away from the drum. The profile of the force exerted on the rod-shaped article or the plurality of linearly arranged substantially cylindrical segments may thus be further improved and the risk of damaging the rod-shaped article or the plurality of linearly arranged substantially cylindrical segments may be reduced further. Upon further rotation of the drum, the rod-shaped article passes the lip and the rest of the contact surface makes the rod-shaped article or the plurality of linearly arranged substantially cylindrical segments roll over the sheet of wrapping material to make the sheet of wrapping material wrap around the rod-shaped article or the plurality of linearly arranged substantially cylindrical segments, as this has been explained above.

According to a further aspect of the apparatus according to the invention, the contact surface of the rolling device at least partially comprises a texture.

Upon contacting the texture, the rod-shaped article or the plurality of linearly arranged substantially cylindrical segments experience an increased resistance ensuring the rolling movement of the rod-shaped article (or of part of the rod-shaped article) or the plurality of linearly arranged substantially cylindrical segments over the contact surface as well as over the sheet material provided on the circumferential surface of the drum, thus preventing an undesired sliding movement of the rod-shaped article or the plurality of linearly arranged substantially cylindrical segments along the contact surface. A texture may be a structure projecting from or being provided in the outer surface and may comprise corrugations, edges, or any other suitable structure.

According to a further aspect of the apparatus according to the invention, the rolling device comprises the resiliently displaceable portion of the outer surface and at least one further portion distinct from the resiliently displaceable portion, the at least one further portion comprising the texture.

As has already been explained above, the resiliently displaceable portion of the outer surface serves to move the rod-shaped article or the plurality of linearly arranged substantially cylindrical segments out of the flute. The at least one further portion of the contact surface comprising the texture is provided for making the rod-shaped article or the plurality of linearly arranged substantially cylindrical segments roll over the sheet of wrapping material so that this sheet material is wrapped around the rod-shaped article. The texture in the at least one further portion may improve the wrapping process, as has been explained above. Thus, the resiliently displaceable portion of the contact surface causes the rod-shaped article or the plurality of linearly arranged substantially cylindrical segments to be moved out of the flute without the rod-shaped article or the plurality of linearly arranged substantially cylindrical segments (or the at least one fragile segment thereof) being damaged, while the at least one further portion of the contact surface having the texture ensures or improves the wrapping of the sheet of wrapping material around the already moved out rod-shaped article or the plurality of linearly arranged substantially cylindrical segments.

According to another aspect of the apparatus according to the invention, the apparatus further comprises an alignment member arranged to support positioning of the rod-shaped article or the plurality of linearly arranged substantially cylindrical segments after being wrapped in the flute of the circumferential drum surface.

To transport the wrapped rod-shaped article or the wrapped plurality of linearly arranged substantially cylindrical segments to a location where the wrapped rod-shaped article or the wrapped plurality of linearly arranged substantially cylindrical segments can be released from the drum for further processing, the wrapped rod-shaped article or the wrapped plurality of linearly arranged substantially cylindrical segments is preferably moved into the next flute (in the direction of rotation of the drum) in the circumferential drum surface. This next flute follows the attachment portion, to which the sheet of wrapping material was held before it was wrapped around the rod-shaped article or the plurality of linearly arranged substantially cylindrical segments. Generally, the rotational speed of the drum is higher than the speed of movement of the rod-shaped article or the plurality of linearly arranged substantially cylindrical segments in the direction of rotation of the drum. In order for the wrapped rod-shaped article or the wrapped plurality of linearly arranged substantially cylindrical segments to roll into the flute and be retained in the flute, an alignment member may be provided to prevent the wrapped rod-shaped article or the wrapped plurality of linearly arranged substantially cylindrical segments from escaping (moving out) of the next flute. For this purpose, by way of example the alignment member may strike against a trailing side of the wrapped rod-shaped article or the wrapped plurality of linearly arranged substantially cylindrical segments (when viewed in the direction of rotation of the drum) thereby preventing the wrapped rod-shaped article or the wrapped plurality of linearly arranged substantially cylindrical segments from escaping (moving out) of the flute. Preferably, an alignment member contacts the wrapped rod-shaped article at several locations distributed over the length of the wrapped rod-shaped article or the wrapped plurality of linearly arranged substantially cylindrical segments, and preferably these several locations are distributed over at least half the total length of the rod-shaped article or of the plurality of linearly arranged substantially cylindrical segments.

During use of the apparatus according to the invention, preferably all flutes arranged between a transfer position (where the unwrapped rod-shaped articles or the unwrapped plurality of linearly arranged substantially cylindrical segments are transferred into the flutes), and a release position (where the wrapped rod-shaped articles or the wrapped plurality of linearly arranged substantially cylindrical segments are released from the flutes for further processing) contain a rod-shaped article. Also, each attachment portion that is arranged between the transfer position and the position where the wrapped rod-shaped articles or the wrapped plurality of linearly arranged substantially cylindrical segments are moved out of the flutes for getting wrapped, holds a sheet of wrapping material. As mentioned already, the wrapping material held on the attachment portion has an outer surface facing away from the attachment portion, and this outer surface has an adhesive thereon. After the rod-shaped article or the plurality of linearly arranged substantially cylindrical segments have been moved out of its flute, they are wrapped with the sheet of material on the adjacent attachment portion and are then positioned in the next flute following this attachment portion (with respect to the direction of rotation of the drum). These process steps are preferably synchronized such that the following to-be-wrapped rod-shaped article or the following plurality of linearly arranged substantially cylindrical segments are moved out of the next flute before the previous wrapped rod-shaped article or the previous wrapped plurality of linearly arranged substantially cylindrical segments are moved into said next flute.

According to another aspect of the invention, there is provided a rolling device for use in an apparatus according to the invention as described above. The rolling device comprises a contact surface adapted to make a rod-shaped article or a plurality of linearly arranged substantially cylindrical segments roll along the contact surface. The contact surface comprises a take-out portion adapted to make the rod-shaped article or the plurality of linearly arranged substantially cylindrical segments move out of a flute provided in a circumferential drum surface of a rotatable drum. The contact surface further comprises a wrapping portion distinct from the take-out portion and has a texture adapted to make the rod-shaped article or the plurality of linearly arranged substantially cylindrical segments roll over a sheet of wrapping material held on the circumferential surface of the rotatable drum. The take-out portion of the outer surface is resiliently displaceable.

According to one aspect of the rolling device according to the invention, the resiliently displaceable take-out portion comprises a lip projecting from the outer surface.

According to another aspect of the rolling device according to the invention, the wrapping portion has a texture on the outer surface.

The advantages of the aspects of the rolling device have already been discussed in combination with the aspects of the apparatus and are therefore not repeated here.

In an apparatus according to the invention, a rolling device may need to be changed for example for maintenance purposes. In addition, if for example a rolling device is required which does not need to have a resiliently displaceable portion, then the rolling device may be replaced by a rolling device having an entirely rigid outer surface, or vice versa. A change of rolling devices may for example be required or favourable when different kinds of rod-shaped articles or of substantially cylindrical segments are to be produced one after the other, especially rod-shaped articles being fragile or comprising fragile segments and rod-shaped articles not being fragile. For example, changing the rolling device may be favourable when a rod-shaped article, such as for example a smoking article or segments of a smoking article comprising a fragile heat source are to be wrapped instead of a conventional smoking article comprising a tobacco rod and a filter rod but no fragile segments.

According to another aspect of the invention, there is provided a method for wrapping a sheet of wrapping material around a rod-shaped article or around a plurality of linearly arranged substantially cylindrical segments, either of which comprises at least one fragile segment. The method comprises the steps of rotating a drum having a central longitudinal axis and a circumferential drum surface, the circumferential drum surface comprising a plurality of flutes. The flutes extend in a direction parallel to the central longitudinal axis of the drum. The circumferential drum surface further comprises attachment portions arranged between the flutes. The method further comprises the steps of holding in the flutes rod-shaped articles or pluralities of linearly arranged substantially cylindrical segments, either of which comprising at least one fragile segment, and holding sheets of a wrapping material against the attachment portions. The outer surfaces of the sheets of wrapping material facing away from the circumferential drum surface have and adhesive thereon. The method further comprises the step of passing the rod-shaped articles (or part of the rod shaped articles) or the pluralities of linearly arranged substantially cylindrical segments between the circumferential drum surface and a contact surface of a rolling device. The contact surface is thereby made to contact the periphery of the respective to-be-wrapped rod-shaped article or the to-be-wrapped plurality of linearly arranged substantially cylindrical segments to move the rod-shaped article or the plurality of linearly arranged substantially cylindrical segments out of the respective flute, and to roll the rod-shaped article or the plurality of linearly arranged substantially cylindrical segments over the outer surface having the adhesive thereon of the wrapping material, which is held on the adjacent attachment portion of the circumferential drum surface. The rod-shaped article or the plurality of linearly arranged substantially cylindrical segments are thereby wrapped with the sheet of wrapping material. Upon making the contact surface contact the periphery of the rod-shaped article or the plurality of linearly arranged substantially cylindrical segments, at least a portion of the contact surface is resiliently displaced away from the circumferential surface of the drum, thus moving the rod-shaped article or the plurality of linearly arranged substantially cylindrical segments out of the respective flute, while preventing the rod-shaped article or the plurality of linearly arranged substantially cylindrical segments (or the at least one fragile segment thereof) from getting damaged.

According to one aspect of the method according to the invention, the step of resiliently displacing a portion of the contact surface is performed by displacing a surface of a spring-biased member.

According to a further aspect of the method according to the invention, the step of moving the rod-shaped article or the plurality of linearly arranged substantially cylindrical segments out of the respective flute comprises providing a lip projecting from the resiliently displaceable portion of the contact surface towards the circumferential drum surface.

According to yet a further aspect of the method according to the invention, the step of rolling the rod-shaped article or the plurality of linearly arranged substantially cylindrical segments along the outer surface having the adhesive thereon of the sheet of wrapping material comprises providing a contact surface having a texture.

According to still a further aspect of the method according to the invention, the method further comprises the step of aligning the rod-shaped article or the plurality of linearly arranged substantially cylindrical segments with the flute in the circumferential drum surface after being wrapped.

The advantages of the aspects of the method according to the invention have already been discussed in combination with the aspects of the apparatus according to the invention and will therefore not be repeated here.

Preferably, the apparatus, rolling device and method according to the invention and as described above are used in the manufacture of smoking articles, especially of smoking articles where tobacco is heated rather than combusted as in conventional cigarettes.

Further advantageous aspects of the apparatus and method according to the invention will become apparent from the following description of embodiments with the aid of the drawings in which.

Figure 1:
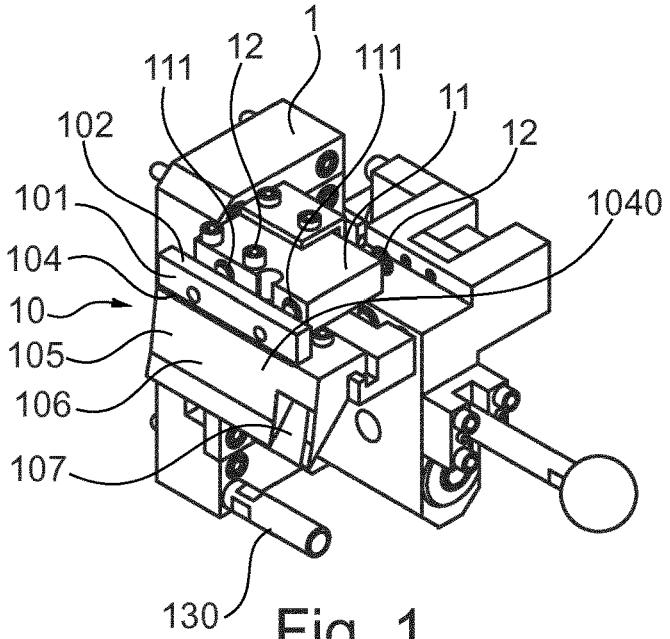
FIG. 1 is a perspective view of a rolling device according to the invention.
Figure 2:
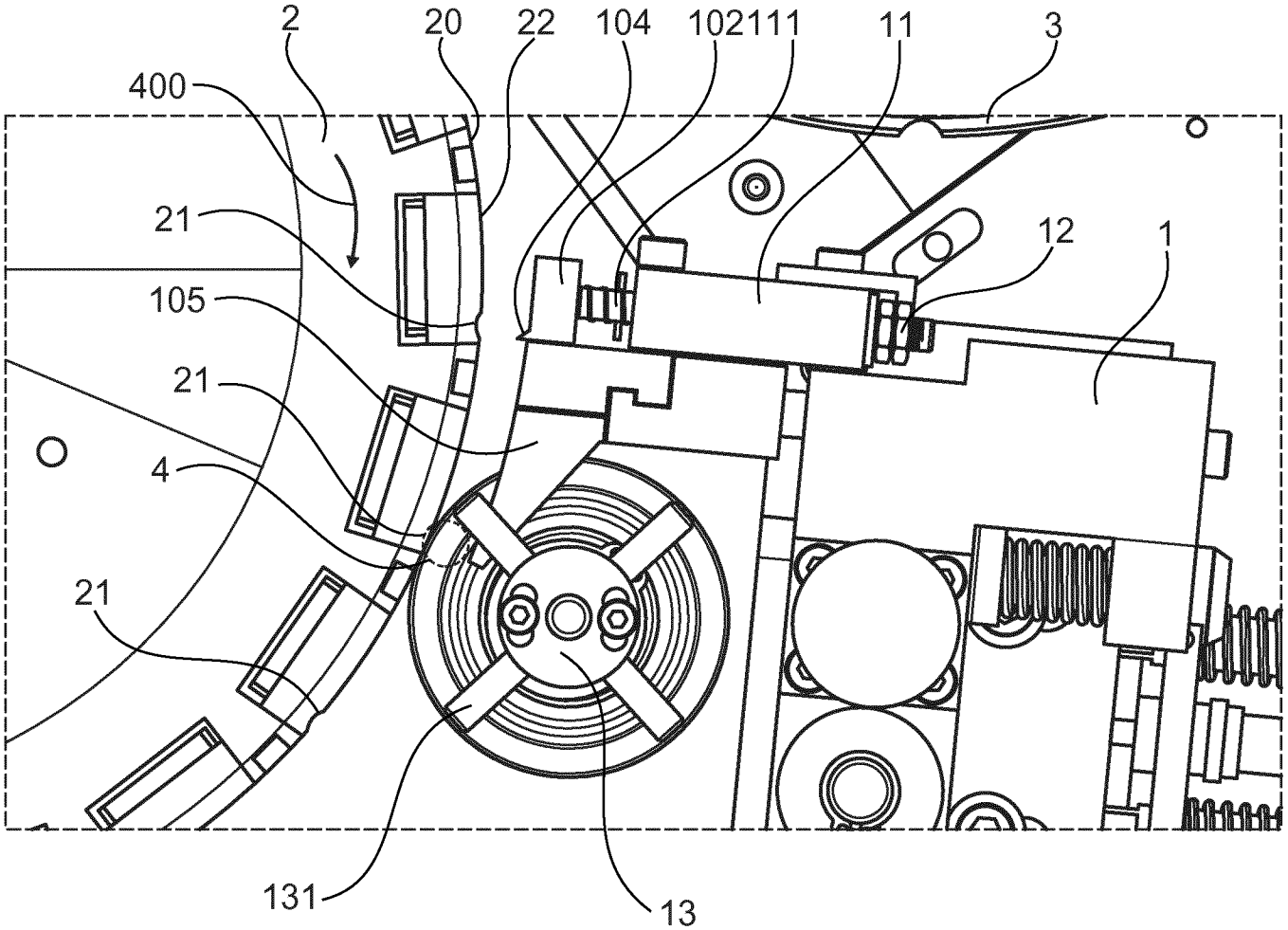
FIG. 2 is a side view of the apparatus according to the invention including the rolling device of FIG. 1.

In FIG. 1 a rolling device 1 according to the invention and in FIG. 2 an apparatus according to the invention comprising such rolling device 1 are shown. In the apparatus, the rolling device 1 is arranged at a distance vis-à-vis to a cylindrical circumferential drum surface 20 of a rotatable drum 2. For the sake of simplicity, the following description refers to the preferred embodiment as regards the shape of the individual segments, that is to say all segments have the shape of a cylinder of circular cross-section. In the following, these segments are referred to as "cylindrical segments". Similar considerations are applicable, however, as regards segments of substantially cylindrical shape which have been referred to above as "substantially cylindrical segments" (see further above).

The rolling device 1 comprises a contact surface 10, which is adapted to make a rod-shaped article or a part of a rod-shaped article or a plurality of linearly arranged cylindrical segments roll along said contact surface 10. In the following, only the case of a rod-shaped article to be wrapped is described in detail for the sake of simplicity, but is similarly applicable with respect to a plurality of cylindrical segments to be wrapped. By making the rod-shaped article roll along contact surface 10, the rod-shaped article is generally transported in the direction of rotation of drum 2, which rotates clockwise. Contact surface 10 comprises a resiliently displaceable (upper) portion 101 being embodied as a surface of a spring-biased member 102. Resiliently displaceable portion 101 is displaceable away from circumferential drum surface 20 towards fixedly mounted support 11 of rolling device 1.

Adjustment screws 12 are provided for an adjustment of the contact surface 10 with respect to its position relative to circumferential drum surface 20 (see FIG. 2) and for an adjustment of the resilient force of the mechanical springs 111 of the spring-biased member 102.

Displaceable portion 101 comprises a lip 104 extending over the entire width of displaceable portion 101 to make the rod-shaped article move out its respective flute. Lip 104 has a triangular cross section, wherein the ridge 1040 of lip 104 projects from displaceable portion 101 of contact surface 10. In the shown horizontal arrangement of triangularly shaped lip 104, a lower side lip 104 essentially extends normal from to the contact surface, while an upper side is sloped in a downward direction.

A fixedly arranged (lower) portion 105 of contact surface 10 is provided for making the rod-shaped article roll along contact surface 10 downwardly in the direction of rotation of drum 2, while the rod-shaped article is being wrapped. Fixedly arranged (lower) portion 105 is provided with corrugations 106 which are formed by a plurality of parallel ribs arranged perpendicular to the direction of movement of the rod-shaped article. Corrugations 106 assist in making the rod-shaped article roll along the fixedly arranged portion 105, and also assist in wrapping the rod-shaped article. Fixedly arranged portion 105 is further provided with a (vertically arranged) opening 107, for example a slit, arranged in a (lower) portion of fixedly arranged (lower) portion 105. Opening 107 is open at the end remote from spring-biased member and allows an alignment post 131 of an alignment member 13 to pass through said opening 107, as this can be seen best in FIG. 2. From FIG. 1 a shaft 130 can be seen to which alignment member 13 (FIG. 2) can be mounted.

Rolling device 1 is arranged such that the contact surface 10 of rolling device 1 faces the circumferential drum surface 20 of drum 2. The distance between contact surface 10 and circumferential surface 20 is adapted to the diameter of a to-be-wrapped rod-shaped article and may be adjusted accordingly, for example by operating one or more adjustment screws 12. Fixedly arranged portion 105 of contact surface 10 of rolling device 1 is slightly curved, this curvature corresponding to the curvature of circumferential drum surface 20. Thus, a rod-shaped article is safely guided in the gap between contact surface 10 and circumferential drum surface 20. Displaceable portion 101 of contact surface 10 is not curved and, as can be seen best in FIG. 2, the distance between displaceable portion 101 of contact surface 10 and circumferential drum surface 20 is greatest at the beginning of the gap and then slightly tapers. This facilitates entry of a rod-shaped article into the gap, such rod-shaped article initially being held in a flute 21 and being moved through clock-wise rotation of drum 2.

The width of contact surface 10 and also the width of the lip 4 are smaller than the width of the rotatable drum 2. The widths of contact surface 10 and lip 104 may be adapted to the width of a sheet of wrapping material which is to be wrapped around the rod-shaped article.

A plurality of flutes 21 each for receiving a rod-shaped article that is fragile or comprises a fragile segment, are uniformly arranged over the circumferential surface 20 of the drum 2. Flutes 21 are arranged parallel to the central longitudinal axis of drum 2, which corresponds to the rotational axis of drum 2. Between the flutes 21 are attachment portions 22, which are arranged for holding a sheet of wrapping material, for example paper, plastic or metal foil or other sheet-like material which are suitable for being wrapped around the rod-shaped article. Depending on the width of the sheet of wrapping material and its desired position on the rod-shaped article, the sheet of wrapping material may be arranged and held on these attachment portions 22.

An alignment member 13 in the form of a cylindrical hub having two sets of four radially extending posts 131 is arranged beneath contact surface 10. The rotational axis of the hub is arranged parallel to the rotational axis of drum 2. Only four posts 131 of a first set of posts are visible in FIG. 2, the four additional posts of the second set of posts are arranged parallel to the four displayed posts are not visible and are guided through opening 107 in fixedly arranged (lower) portion 105 of contact surface 10 (see FIG. 1) of rolling device 1. Upon rotation of alignment member 13 two posts 131 (one of each set of posts) pass into the gap between contacts surface 10 and circumferential drum surface 20 at the same time and may strike against a trailing end of an already wrapped rod-shaped article 4 (indicated by the circle in FIG. 2) so as to make sure that the wrapped rod-shaped article 4 is held in flute 21 and may not escape therefrom. Posts 131 thereby prevent a movement of a wrapped rod-shaped article 4 in a direction counter the direction of rotation of drum 2. The two sets of posts 131 are arranged spaced from each other so as to contact the rod-shaped article simultaneously at two different locations along the length of the rod-shaped article. Twisting of the rod-shaped article 4 can thereby be prevented. The rotational speeds of drum 2 and of alignment member 13 are synchronized accordingly.

Figure 3:
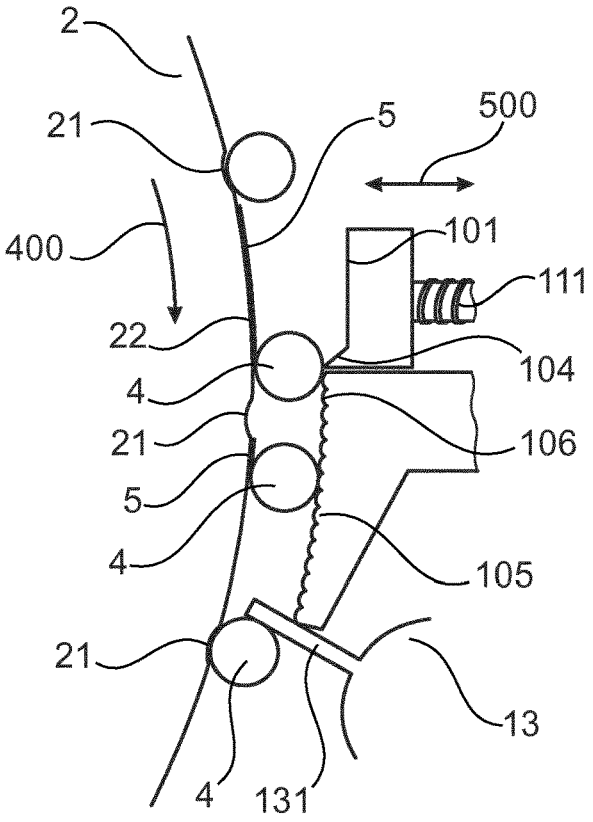
FIG. 3 is a schematic snapshot showing the apparatus according to the invention in operation.

FIG. 3 shows a snapshot of the apparatus according to the invention in operation. There can be seen (in clockwise direction): a to-be-wrapped rod-shaped article held in the uppermost flute 21 shown, a rod-shaped article 4 immediately after having been moved out the second uppermost flute 21, this rod-shaped article being about to roll over a sheet of wrapping material 5 having an adhesive on its outer surface facing away from drum 2, a nearly completely wrapped rod-shaped article 4 arranged between corrugated portion 105 of contact surface 10 and circumferential drum surface 20, and a completely wrapped rod-shaped article 4 held in a flute 21 of the rotating drum 2 and being prevented from escaping by posts 131 of alignment member 13.

Drum 2 rotates in clockwise direction as indicated by arrow 400. A to-be-wrapped rod-shaped article 4 held in flute 21 is moved by rotation of drum 2 towards rolling device 1 (see, for example, the uppermost rod-shaped article in FIG. 3). As the to-be-wrapped rod-shaped article 4 reaches the rolling device, the periphery or a portion of the periphery of the to-be-wrapped rod-shaped article 4 comes into contact with the lip 104 of displaceable portion 101 of contact surface 10 of rolling device 1. Through the continued rotational movement of drum 2 and the lip 104 contacting the to-be-wrapped rod-shaped article 4, a force is exerted onto rod-shaped article 4. As a result of this force, rod-shaped article 4 is moved out of flute 21. The extension of the lip 104 makes sure that the force is homogeneously exerted over that portion of the length of the rod-shaped article corresponding to the extension of the lip 104.

Lip 104, which is part of the resiliently displaceable portion 101, is displaced in a direction away from circumferential drum surface 20 as the rod-shaped article 4 is moved out of its flute 21 (indicated by double-arrow 500). In FIG. 3, the resiliently displaceable portion 101 of contact surface 10 is shown in a retracted position. Once the rod-shaped article 4 has been moved out of flute 21, the displaced portion is returned back to its original position in the direction towards circumferential drum surface 20 by the resilient forces of springs 111 so as to be arranged in a position to make the next rod-shaped article 4 move out of its the flute upon reaching lip 104.

By displacing the resiliently displaceable portion 101 of contact surface 10, the force exerted on rod-shaped article 4 is reduced while still making the rod-shaped article move out of flute 21. Thus, the rod-shaped article or a fragile segment thereof is prevented from getting damaged. Accordingly, the spring means 111 are adapted to make the lip 104 exert a force onto the rod-shaped article 4 high enough to make the rod-shaped article 4 move out of the flute on one hand. On the other hand, the spring means 111 are adapted to make the lip exert a force onto the rod-shaped article 4 low enough not to damage or break the rod-shaped article or a fragile segment thereof. The sloped surface of lip 104 supports a continuous movement of rod-shaped article 4 along said sloping surface of lip 104 during movement of the rod-shaped article 4 out of flute 21 and onto the sheet of wrapping material 5.

After the rod-shaped article has been moved out of flute (see second uppermost rod-shaped article in FIG. 3), the to-be-wrapped rod-shaped article 4 or the to-be-wrapped part of rod-shaped article 4 rolls over the outer surface of the sheet of wrapping material 5 having the adhesive thereon. The direction of rotation of the rod-shaped article 4 over the sheet of wrapping material is counter-clockwise, counter to the direction of rotation of drum 2. Thus, the sheet of wrapping material 5 provided on the attachment portion 22 directly adjacent and following flute 21 from which the rod-shaped article has been moved out, is made to wrap around the rod-shaped article 4. Relative to the sheet material 5, the rod-shaped article 4 is rotated counter-clockwise to get wrapped. Viewed in its entirety, the rod-shaped article with respect to the contact surface 10 of rolling device 1 rolls over contact surface 10 in the direction of rotation of drum 2, i.e. clockwise.

After having passed lip 104, the rod-shaped article rolls over fixedly arranged corrugated portion 105 of contact surface 10. While rolling along fixedly arranged corrugated portion 105, the rod-shaped article 4 rolls over the sheet of wrapping material 5 and is thereby completely wrapped (see second lowermost rod-shaped article in FIG. 3). Upon reaching the end of the fixedly arranged corrugated portion 105 of contact surface 10, it is introduced into the next empty flute 21 (from which a next rod-shaped article has been moved out before), that follows the attachment portion 22 to which the sheet of wrapping material 5 was held before being wrapped around the rod-shaped article. To make sure that the wrapped rod-shaped article 4 is positioned and held in flute 21 and may not escape (move out) therefrom, alignment member 13 with posts 131 is provided to help prevent the wrapped rod-shaped article 4 from escaping (moving out) of flute 21. For that purpose post 131 of alignment member 13 may tenderly strike against the trailing side of wrapped rod-shaped article 4. The wrapped rod-shaped article is then transported in flute 21 by rotation of the drum 2 to a release position where it is released from flute 21 and from drum 2 for further processing.

In the embodiment described, the resiliently displaceable portion 101 serves as a take-out portion only and the fixedly arranged corrugated portion 105 serves as wrapping portion only. However, also other embodiments may be envisaged, wherein take-out portion and wrapping portion are not physically separate portions. For example, the resiliently displaceable upper portion may also serve as part of a wrapping portion.

As partly indicated in FIG. 2, a supply drum 3 is arranged close to drum 2 to provide the to-be-wrapped rod-shaped articles, which are transferred from supply drum 3 to drum 2. For example, the transfer of the two-be-wrapped rod-shaped articles to the flutes 21 of drum 2 may occur at a position between a 10 o'clock and a 12 o'clock position of drum 2. Flutes 21 and attachment portions 22 may be provided with openings for the application of suction through said openings. A suction device, such as a vacuum unit may be provided in fluid connection with these openings in the circumferential drum surface 20. Suction may hold rod-shaped articles 4 in flutes 21 and may also hold the sheets of wrapping material 5 against the attachment portions 22. A release position for the wrapped rod-shaped articles may be located at a position, for example, between a 4 o'clock and an 8 o'clock position of drum 2. A release of the rod-shaped articles from the flutes may occur though gravitational force only or may be supported by an interruption of suction or may be supported by the application of overpressure through the openings provided in the flutes. The suction applied to the attachment portions is at least not interrupted during the wrapping procedure. Rather, the adhesive force of the adhesive on the outer surface of the sheet of wrapping material and the force acting on the rod-shaped article being rolled over the sheet of wrapping material are adapted to overcome the holding force provided by the suction, so that the sheet of wrapping material is wrapped around the rod-shaped article.

Figure 4:
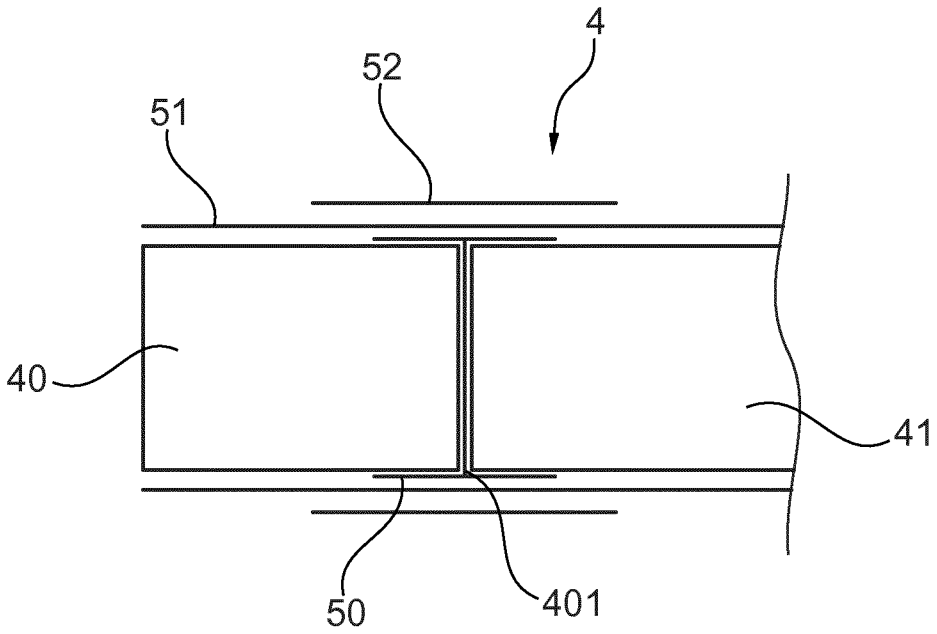
FIG. 4 is a portion of a rod-shaped article wrapped with an apparatus according to the invention.

FIG. 4 shows the front part of an embodiment of a rod-shaped smoking article 4.

The front part of the rod-shape article 4 comprises a heat source 40 and a tobacco containing segment 41 which are connected via a first heat-conducting wrapper 50, for example a metal foil such as an aluminum foil. The first heat-conducting wrapper 50 extends over a portion of heat source 40 and over a portion of tobacco containing segment 41. Heat source 40, which can be a brittle heat source, such as a carbonaceous heat source, may be wrapped at its rear end, too. First heat-conducting wrapper 50 may serve for a good dissipation of heat. A second wrapper 51 preferably made of a material that may withstand the temperatures produced by the heat source 40 wraps a large portion of or the entire smoking article 4. The second wrapper generally serves to connect most or all segments or components of the smoking article 4 and also may serve for an attractive optical appearance of the smoking article 4. A third wrapper 52 extends over a portion of heat source 40 and over a portion of tobacco containing segment 41, and is wrapped around the second wrapper 51. Third wrapper 52 is made of a heat conducting material and may be made from the same material as the first wrapper 50. While for example, third wrapper 52 may be applied with an apparatus and method according to the invention, the apparatus and method according to the invention are also suitable for the application of the first wrapper 50 and the second wrapper 51.

While embodiments of the invention have been described hereinbefore, the invention is not limited to these embodiments. Rather, various modifications and changes are conceivable without departing from the teaching of the instant invention. Therefore, the scope of protection is defined by the appended claims.

The invention claimed is:

1. Apparatus for wrapping a sheet of wrapping material around a rod-shaped article or around a plurality of linearly arranged substantially cylindrical segments, either of which comprising at least one fragile segment, the apparatus comprising:

a rotatable drum having a central longitudinal axis and a circumferential drum surface, the circumferential drum surface comprising a plurality of flutes, the plurality of flutes being arranged in the circumferential drum surface and extending in a direction parallel to the central longitudinal axis of the drum, with each respective flute of the plurality of flutes being adapted to hold within it a respective rod-shaped article or a respective plurality of linearly arranged substantially cylindrical segments, either of which comprising at least one fragile segment, the circumferential drum surface further comprising respective attachment portions arranged between the respective flutes of the plurality of flutes, each respective attachment portion configured to hold a respective sheet of wrapping material against the respective attachment portion separate from the respective rod-shaped article or the respective plurality of linearly arranged substantially cylindrical segments held in the flutes, with the respective sheet of wrapping material having an adhesive on an outer surface of the wrapping material facing away from the circumferential drum surface;

a rolling device comprising a contact surface arranged at a predetermined distance from the circumferential drum surface, the predetermined distance being chosen such that the contact surface is to contact a periphery of the respective to-be-wrapped rod-shaped article or the respective to-be-wrapped plurality of linearly arranged substantially cylindrical segments held in the respective flute separate from the respective sheet of wrapping material in a manner such as to make the respective rod-shaped article or the respective plurality of linearly arranged substantially cylindrical segments move out of the respective flute and roll over the outer surface having the adhesive thereon of the respective sheet of wrapping material held on the respective adjacent attachment portion to wrap the sheet of wrapping material around the respective rod-shaped article or around the respective plurality of linearly arranged substantially cylindrical segments, wherein the contact surface comprises an upper portion which is resiliently displaceable away from the circumferential drum surface for moving the rod-shaped article or the plurality of linearly arranged substantially cylindrical segments out of the respective flute of the plurality of flutes, and a lower portion which is fixedly arranged for making the rod-shaped article or the plurality of linearly arranged substantially cylindrical segments roll along the contact surface and over the respective attachment portion directly adjacent to and following the respective flute, the lower portion being arranged downstream of the upper portion in the direction of rotation of the drum, wherein the resiliently displaceable portion is resiliently displaced away from the circumferential surface of the drum upon making contact with the periphery of the respective to-be-wrapped rod-shaped article or the respective to-be-wrapped plurality of linearly arranged substantially cylindrical segments, and the resiliently displaceable upper portion of the contact surface comprises a lip projecting towards the circumferential drum surface, wherein the lip has a triangular cross-section and wherein a ridge of the lip projects from the resiliently displaceable upper portion of the contact surface towards the circumferential drum surface; and a rotatable alignment member which is arranged beneath the contact surface and which is in the form of a cylindrical hub having a first set of four radially extending posts and a second set of four radially extending posts, wherein each post of the first set of four radially extending posts is respectively arranged parallel to a corresponding post of the second set of four radially extending posts, the alignment member being arranged to support positioning of the respective rod-shaped article or the respective plurality of linearly arranged substantially cylindrical segments in an empty flute of the circumferential drum surface after being wrapped, one of the first set of four radially extending posts and the corresponding post of the second set of four radially extending posts striking against a trailing end of the already wrapped rod-shaped article or the respective plurality of linearly arranged substantially cylindrical segments.

2. Apparatus according to claim 1, wherein the resiliently displaceable upper portion of the contact surface is a surface of a spring-mounted member.

3. Apparatus according to claim 1, wherein the contact surface of the rolling device at least partially comprises a structure projecting from or being provided in the contact surface.

4. Apparatus according to claim 3, wherein the structure is arranged on the fixedly arranged lower portion.

5. Method for wrapping a sheet of wrapping material around a rod-shaped article or around a plurality of linearly arranged substantially cylindrical segments, either of which comprising at least one fragile segment, the method comprising the steps of:

rotating a drum having a central longitudinal axis and a circumferential drum surface, the circumferential drum surface comprising a plurality of flutes being arranged within the circumferential surface and extending in a direction parallel to the central longitudinal axis of the drum, the circumferential drum surface further comprising respective attachment portions arranged between the respective flutes of the plurality of flutes, holding in the respective flute of the plurality of flutes a respective rod-shaped article or a plurality of linearly arranged substantially cylindrical segments, either of which comprising at least one fragile segment, holding a respective sheet of a wrapping material having an adhesive on an outer surface of the wrapping material against each respective attachment portion and separate from the rod-shaped article or the plurality of substantially cylindrical segments held in the respective flute, with the outer surface having the adhesive thereon facing away from the circumferential drum surface, passing the respective rod-shaped article or the respective pluralities of linearly arranged substantially cylindrical segments between the circumferential drum surface and a contact surface of a rolling device, thereby making the contact surface contact a periphery of a respective to-be-wrapped rod-shaped article or a respective to-be-wrapped plurality of linearly arranged substantially cylindrical segments, move the respective rod-shaped article or the respective plurality of linearly arranged substantially cylindrical segments out of the respective flute, and roll the respective rod-shaped article or the respective plurality of linearly arranged substantially cylindrical segments over the outer surface having the adhesive thereon of the respective sheet of wrapping material separately held on the respective adjacent attachment portion, thereby wrapping the respective rod-shaped article or the respective plurality of linearly arranged substantially cylindrical segments with the respective sheet of wrapping material, wherein the contact surface comprises a resiliently displaceable upper portion for moving the rod-shaped article or the plurality of linearly arranged substantially cylindrical segments out of the respective flute of the plurality of flutes, and a lower portion which is fixedly arranged for making the rod-shaped article or the plurality of linearly arranged substantially cylindrical segments roll along the contact surface and over the respective attachment portion directly adjacent to and following the respective flute, the lower portion being arranged downstream of the upper portion in the direction of rotation of the drum, wherein after making the resiliently arranged upper portion of the contact surface contact the periphery of the respective rod-shaped article or the respective plurality of linearly arranged substantially cylindrical segments the upper portion of the contact surface is resiliently displaced away from the circumferential drum surface thus moving the respective rod-shaped article or the respective plurality of linearly arranged substantially cylindrical segments held in the respective flute separate from the respective sheet of wrapping material out of the respective flute, wherein moving the respective rod-shaped article or the respective plurality of linearly arranged cylindrical segments out of the respective flute comprises providing a lip projecting from the resiliently displaceable upper portion of the contact surface towards the circumferential drum surface, the lip having a triangular cross-section, wherein a ridge of the lip projects from the resiliently displaceable upper portion of the contact surface towards the circumferential drum surface, and aligning the respective rod-shaped article or the respective plurality of linearly arranged substantially cylindrical segments with an empty flute in the circumferential drum surface after being wrapped, by means of two parallel arranged posts of an alignment member striking against a trailing end of the already wrapped rod-shaped article or the respective plurality of linearly arranged substantially cylindrical segments, the alignment member being arranged beneath the contact surface and being in the form of a cylindrical hub having a first set of four radially extending posts and a second set of four radially extending posts, wherein each post of the first set of four radially extending posts is respectively arranged parallel to a corresponding post of the second set of four radially extending posts, the two parallel arranged posts striking against the trailing end of the already wrapped rod-shaped article or the respective plurality of linearly arranged substantially cylindrical segments being one of the first set of four radially extending posts and the corresponding post of the second set of four radially extending posts.

6. Method according to claim 5, wherein resiliently displacing the upper portion of the contact surface is performed by displacing a surface of a spring-biased member.

7. Method according to claim 5, wherein rolling the respective rod-shaped article or the respective plurality of linearly arranged cylindrical segments along the outer surface having the adhesive thereon of the respective sheet of wrapping material comprises providing a structure projecting from or being provided in the contact surface.

* * * * *